United States Patent [19]

Perlman

[11] Patent Number: 5,051,596

[45] Date of Patent: Sep. 24, 1991

[54] AUTOGRAPHY MARKING TAPE

[75] Inventor: Daniel Perlman, Arlington, Mass.

[73] Assignee: Brandeis University, Waltham, Mass.

[21] Appl. No.: 548,057

[22] Filed: Jul. 5, 1990

[51] Int. Cl.[5] ..... G03C 5/16

[52] U.S. Cl. ..... 250/458.1; 250/303; 250/461.1; 250/462.1; 250/475.2; 378/162

[58] Field of Search ..... 250/475.2, 462.1, 303, 250/461.1, 459.1, 458.1; 378/164, 163, 162

[56] References Cited

U.S. PATENT DOCUMENTS

| | | | |
|---|---|---|---|
| 2,341,583 | 2/1944 | Tuve | 250/462.1 |
| 2,396,219 | 3/1946 | Weagle | 252/301.65 |
| 3,631,243 | 12/1971 | Byler | 378/166 |
| 4,181,859 | 1/1980 | Vitalini | 378/164 |
| 4,293,436 | 10/1981 | Fost | 252/645 |
| 4,506,676 | 3/1985 | Duska | 128/653 |
| 4,510,392 | 4/1985 | Litt et al. | 250/475.2 |
| 4,813,062 | 3/1989 | Gilpatrick | 378/162 |

FOREIGN PATENT DOCUMENTS

| | | | |
|---|---|---|---|
| 227520 | 9/1984 | German Democratic Rep. | 250/461.1 |
| 1-245239 | 9/1989 | Japan | 378/165 |

*Primary Examiner*—Constantine Hannaher
*Attorney, Agent, or Firm*—Lyon & Lyon

[57] ABSTRACT

Marking tape adapted for use in autography, comprising: a substrate having an upper surface, a phosphorescent coating applied to the upper surface, the coating including phosphor powder grains, the grains phosphorescing with light at a wavelength between 400 and 600 nm upon exposure to UV or visible light, the phosphorescing occurring for a period of at least 5 minutes after the exposure, the concentration of the grains being sufficient to emit sufficient photons and thereby cause X-ray film having a sensitivity of 2000 EI to darken to an optical density of between 0.2 and 3.0.

14 Claims, No Drawings

AUTOGRAPHY MARKING TAPE

BACKGROUND OF THE INVENTION

This invention relates to use of a phosphorescent dye to emit light and create a mark on photographic film during autography.

Autography is a process utilized in scientific research and clinical diagnostic procedures where the distribution of a radioactive or a photon-emitting substance, e.g., a radioactive isotope-containing compound or chemiluminescent material, in a "labelled" or "tagged" object, surface, or material (e.g., a flat dried electrophoretic slab gel) is visualized. Typically, this visualization is by placing a sheet of photographic film (e.g., X-ray film) adjacent to, preferably in contact with, the object for a period of time and then developing the film to form an autogram. The pattern of ionizing radioactivity or photon-emitter in the object generates a corresponding dark pattern against a light or transparent background on the film. When the labelled-emitter substance is a radioactive compound the process is called autoradiography and the developed film an autoradiogram.

It is useful to identify an autogram by placing some form of reference marking on the object which will, in turn, cause a recognizable pattern on the film. Such a pattern assures that the original object and the developed film can be identified as a pair, and that corresponding locations on the object and film can be determined.

Two methods of marking autoradiograms have been and are currently utilized in laboratories. One method involves marking a radioactively tagged object, in an area lacking radioactivity, with dark radioactive ink. The other method involves marking radioactive or non-radioactive objects in untagged areas with phosphorescent (luminescent) ink. Both methods are described by Litt et al., U.S. Pat. No. 4,510,392. Litt et al. describe the problems and disadvantages associated with use of a radioactive ink marking means such as a pen or dotting devices as follows:

"1. Leakage can lead to general, although low level contamination.

2. Multiple pens must be prepared as it is necessary to approximate the amount of radioactivity in the substrate. In addition, it is necessary in many cases to match the particular radionuclide under study.

3. The intensity of marking actually attained on the film is dependent not only upon time of exposure and radionuclide energy, but also is affected by the plastic overlays commonly used and, in some special cases, temperature.

4. There is significant potential for 'abuse' in that a convenient pen will potentially migrate from the laboratory."

The phosphorescent ink marking method of Litt et al., is used in a commercially available pen manufactured and sold by DuPont NEN Products. The pen dispenses a thick ink carrying, in suspension, a phosphor formed of hexagonal Wurtzite crystals of zinc sulfide doped with various trace metals. After the ink markings are made and have dried on the object to be autographed, the object is exposed to actinic or ordinary room light to activate the phosphor. Shortly thereafter the object is placed in contact with X-ray film. Phosphorescence generated from the dried ink is almost exhausted within thirty minutes. Therefore an autographic film exposure carried out for thirty minutes or more will, upon photographic development, exhibit more or less constant and predictable darkened markings corresponding to the phosphorescent ink markings.

In the field of medical X-ray diagnosis, an apparatus described by Byler, U.S. Pat. No. 3,631,243 employs a short afterglow phosphorescent marking unit for X-ray film. The phosphorescent surface of the unit is first overlaid with identifying indicia (e.g., the patient's name), then exposed to room light and immediately inserted into and, 4–5 seconds later, withdrawn from a specialized housing containing the X-ray film. The short afterglow phosphorescent composition (such as a variety of copper-activated zinc sulfide) on the marking unit is selected so that it is energizable to emit visible light which decays rapidly in brightness from a maximum immediately after energization. The rapid completion of phosphorescent light emission from the unit generates a constant and predictable film darkening over the phosphorescent marking unit after a film exposure of several seconds. The marking unit of Byler must be inserted quickly, e.g., in about 0.4 seconds, and held against the film for only about 4 or 5 seconds, after which "the diminishing afterglow from the phosphor does not add significantly to the cumulative light output . . .". The rapid decay necessitates a rapidly insertable unit and various hardware design features including a "guiding means constructed to guide the unit so that when the unit is inserted into the film-loaded housing through said aperture the film is immediately and directly exposed to any emitted light . . ."

SUMMARY OF THE INVENTION

The present invention is designed to overcome significant shortcomings of the phosphorescent ink of Litt et al. and the phosphorescent insertion unit of Byler when used in autoradiography.

The phosphorescent ink of Litt et al. creates uneven developed film images which are difficult to read. This problem is caused by the difficulty in writing with a phosphorescent ink or paint which must remain sufficiently thick and viscous to hold the luminescent crystalline phosphor in suspension. Furthermore, the ink's light green color (which is designed to match the emission color of the phosphor) makes it difficult to see against the light colored or white background of some autogram substrate materials. Darker pigments cannot be added to the ink to improve legibility because these attenuate phosphorescence. Consequently, it is difficult to align the developed film with the original ink-bearing substrate material. Finally, the phosphorescent hexagonal Wurtzite form of zinc sulfide used in the commercial embodiment of Litt et al. is strongly phosphorescent and, depending upon the amount of ink deposited by the pen, can cause overexposure of the film making the markings hard to interpret. Simply diluting the ink causes an undesirable graininess in the appearance of the markings on the developed film.

The phosphorescent insertion unit of Byler is designed for medical X-ray use and is not of practical use in marking autograms. Autograms often require a plurality of spaced notations and reference markings to make correlations between the substrate and the film. These markings are of sizes and at positions which vary from experiment to experiment rather than being reproducible and fixed as in the Byler device. Furthermore, the autographic film utilized with the present invention is usually rendered physically inaccessible to an externally inserted marking device since the film is sequestered with the photonemitting substrate (e.g., tightly wrapped with aluminum foil) to assure intimate contact between the film and substrate. The phosphor used by Byler is also non-useful for autography purposes because of the phosphor's short afterglow following photo-excitation. Byler states that the unit's emitted light decays in brightness rapidly after a few seconds of exposure to the film (so that the unit can either be removed or left in place because there is little additional light output). This rapid decay of light emission would preclude autographic use of the unit because, prior to film exposure, at least a minute in the darkroom is typically required to take a sheet of film from its box and immobilize the film against the radioactive or photonemitting substrate. Therefore, the afterglow of a phosphor used in autography must be at least five minutes and preferably 10–30 minutes (rather than 4–5 seconds). If the afterglow is any shorter than five minutes, the variable darkroom time spent in juxtapositioning the film and the substrate will result in unpredictable and often insufficient film darkening.

Thus, in a first aspect, the invention features marking tape adapted for use in autography. The tape includes a substrate having a phosphorescent coating applied to one surface. The coating includes phosphor powder grains which emit phosphorescent light with a wavelength between 400 nm and 600 nm upon exposure to ultraviolet (UV) or visible light (e.g., held at a distance of one meter from a standard non-fluorescent 100 Watt bulb) for one minute. This phosphorescence continues for a period of at least 5 minutes after exposure to light. The concentration of the grains is sufficient to emit sufficient photons over a 30 minute period to cause X-ray film having a white light sensitivity of 2000 EI, as measured in standard exposure index (EI) units, to darken to an optical density (measured by standard photometric procedure) of between 0.2 and 3.0 at 20° C.

In preferred embodiments, the coating includes phosphor powder grains smaller than 100 mesh size, most preferably smaller than 150 mesh size; the coating is formed by screen printing; the X-ray film darkening measured by optical density is between 1.0 and 2.0; the upper surface of the tape's substrate is coated with phosphor and the lower surface with adhesive, e.g., pressure-sensitive adhesive provided with a protective layer to prevent adhesion of the adhesive prior to use of the marking tape.

In other preferred embodiments, the phosphorescent coating further includes a marking layer which either prevents the grains from phosphorescing in response to UV or visible light or prevents the phosphorescence of the grains occurring through the layer, e.g., the layer is a black ink, or India ink; the lower surface of the tape is applied to an object to be autographed, e.g., a polyacrylamide gel, and the object is placed adjacent an X-ray film.

In a related aspect, the invention features a method for marking an X-ray film during autography. The method includes providing a marking tape as described above; marking the upper surface of the phosphorescent coating of the marking tape with an ink which either prevents the grains from phosphorescing at points beneath the ink or prevents photons emitted by phosphorescence beneath the ink from contacting the X-ray film at points adjacent to, i.e., above, the ink; placing the marking tape on an object having a radioactive or photon-emitting material; exposing the marking tape to ultraviolet or visible light to cause the grains to phosphoresce; placing the object and the marking tape adjacent an X-ray film; and allowing radioactivety or photons from the object and photons from the marking tape to contact the X-ray film.

It is important in this invention to provide a marking tape which creates a dark background on an X-ray film, with light areas corresponding to locations on which dark ink is placed on the tape. Thus, it is important that the phosphorescent coating not emit too great a number of photons and thereby overexpose the X-ray film. To this end, any phosphorescent coating equivalent to those described in the examples below is useful in this invention. Thus, any coating which emits by phosphorescence an equivalent number of photons (for the same input of light) to a coating having between 0.5 and 5 $g/m^2$ of the trace metal activated zinc sulfide crystals described in Example 1 is useful.

Other features and advantages of the invention will be apparent from the following description of the preferred embodiments, and from the claims.

DESCRIPTION OF THE PREFERRED EMBODIMENTS

The present invention provides apparatus and a method for identifying and marking autograms by attaching one or more pieces of long-afterglow, weakly phosphorescent pressure-sensitive adhesive tape to an essentially two-dimensional surface, material, or object to be autographed. The object may be any object which is routinely autographed, e.g., an electrophoretic slab gel dried onto filter paper and containing a radioactive substance or isotope; a permeable membrane onto which radioactive substances have been transferred; or animal or plant tissue sections and chromatograms containing radioactivity. For identification purposes the tape is marked or written upon with a conventional dark or opaque ink using a pen, or typed upon using a dark typing ribbon. After attaching the tape to the object and photoactivating the phosphor with light, e.g., ordinary room light, the object with tape attached is taken into the darkroom and juxtaposed and immobilized against a sheet of photographic or X-ray film. The object and juxtaposed film are placed in a light-tight envelope or cassette for exposure. The duration of an autoradiographic exposure typically ranges from about 1 hour to 1 month. The low level phosphorescent light emanating from everywhere on the phosphorescent tape, except from the dark ink markings, results in exposure of the juxtaposed film.

The concentration of phosphorescent material and its chemical composition (which determines its photoemission wavelengths) are chosen to produce a small but sufficient amount of light at one or more wavelengths to which the film is sensitive, to cause adequate film darkening (optical density of approximately 0.2–3.0 following development) and sufficient optical contrast with the ink markings to permit their easy visualization. Brightly visible phosphorescence produced by concentrated commercial luminescent zinc sulfide pigment preparations (used for "glow in the dark" product applications) is avoided. Such phosphorescence causes excessive film darkening over the entire tape and a related loss of optical contrast and definition of the image of the markings on the film as phosphorescent light leaks across these markings (rendering the tape non-functional for autographic use). The afterglow or lifetime of the phosphor's light emission following photoexcitation (e.g., by room light) must be at least five minutes and preferably 10–30 minutes. This phosphorescence lifetime permits the laboratory worker to have adequate darkroom time (after the light has been turned off) to place the juxtaposed film and substrate material in an appropriate light-sealed holding device. If the phosphor's afterglow is too brief (less than five minutes), there will be variability in the film darkening (resulting from the variable afterglow of the phosphor). If the phosphorescence is too intense for too brief an interval, a blurring of the marking tape image and a hazing of the adjacent unexposed film may also result (a phenomenon similar to moving a camera while taking a picture). Conversely, too weak a phosphorescence produces inadequate film darkening for good autographic registration.

X-ray film and other types of film which are generally used in autography have sensitivities primarily within the blue color range. Therefore, to be useful in the present invention, phosphorescent pigments should emit most of their light in the range of 400–600 nm. Phosphors having a high emission wavelength range, e.g., 500 nm or greater (yellow to yellow-green color range), are especially useful in the present invention. Some trace metal activated crystalline zinc sulfide preparations, as, for example, sold by Hanovia, Inc., Newark, N.J. (series 1000 pigment with a yellowish emission wavelength maximum of 560 nm) are examples of such useful phosphors.

Some fluorescent pigments which emit bright colored light during exposure to UV light, are also weakly phosphorescent after exposure to room light, and some which are phosphorescent in the green and yellow-green color ranges, exhibit long afterglow (as much as one hour). For example, the off-white pigment, "#30 invisible green" (a zinc sulfide preparation which appears green under UV light) manufactured by Shannon Luminous Materials, Inc., Santa Ana, Calif.

Phosphor powder grains should be no larger than approximately 100 or 150 mesh to minimize grainy film images. With an appropriate fine powder, a more uniform film image of the phosphorescent label is achieved.

Generally in the manufacture of autography marking tape, a conventional thin flexible substrate material suitable for producing pressure sensitive tape receives a uniform coating of a weakly phosphorescent paint carrying one or more pigment materials, e.g., crystalline zinc sulfide doped with trace metals emitting light in the abovedescribed wavelength range. By incorporating an appropriate concentration of long afterglow phosphorescent pigment material into a conventional paint vehicle such as lacquer or enamel base and applying this paint uniformly, e.g., by silk screen process, to an inert and relatively thin flat substrate material, an appropriate phosphorescent tape for marking autoradiograms is obtained. The form of substrate for this phosphorescent marking surface is preferably a moisture resistant or waterproof pressure-sensitive tape which may be die cut into various shapes for convenience. Moisture-resistance assures that following film exposure at freezer temperatures (often utilized in autography) the formation of condensation at room temperature will not significantly damage or cause peeling of the tape. For writing purposes, a simple waterproof blank ink pen (such as the "Sharpie" manufactured by Sanford, Inc.) is typically utilized to write identification markings on the phosphorescent tape before or after attaching the tape to a radioactively tagged object for autoradiography.

EXAMPLE 1

A conventional printable label material (consisting of a pressure-sensitive adhesive-backed flexible paper sheet material provided with a peelable protective release backing sheet as purchased from Avery, Inc.) was coated with phosphorescent paint as follows: Spot-Lite P1000 pigment comprising a trace metal-activated crystalline zinc sulfide phosphorescent powder (phosphorescing in the range of 560 nm wavelength) was obtained from Hanovia Inc., Newark, N.J. (containing between 2 and 5 parts per million each of copper, lead, chromium, beryllium, arsenic, and mercury) and suspended at a concentration of 0.3–5.0 g pigment per 100 g of ink or paint (white silk-screen process ink containing a nitrocellulose and lacquer base). The resulting ink contained only 2–20% of the normal concentration of pigment routinely used in "glow in the dark" paint (typically about 25% (w/w) pigment) and was weakly phosphorescent. This ink was screen-printed through 8–10 xx monofilament polyester mesh and also through 120–145 mesh stainless steel screens. The final density of phosphor ranged from approximately 0.5 to 5.0 grams per square meter of label material. The resulting coated paper label material was cut into 1"×2" rectangular labels for autography use. A black felt-tipped pen or a typewriter with a black ribbon was used to mark the tape, which was then attached, via its adhesive backing, to a $^{35}S$-radioisotope-labelled DNA sequencing gel (6% polyacrylamide gel which had been vacuum dried) on Whatman 3MM filter paper. The dried gel and marked tape was exposed to either incandescent or fluorescent room light for about 15 seconds, then carried into a darkroom and placed against X-ray film (Kodak XAR-5) within three minutes of having been exposed to light. After an overnight autoradiographic exposure, the film was developed, revealing sharp, transparent, highly legible typed and hand-written markings against an otherwise dark, sharply delineated rectangular shape measuring 1"×2" corresponding to the size and shape of the original label.

EXAMPLE 2

Autoradiographic marking labels similar to those described in Example 1 were prepared on adhesive backed pressure-sensitive paper except that an ultraviolet light-fluorescent paint (also termed black-light paint), was used without dilution, in place of the ink of Example 1. The fluorescent paint which was discovered to be weakly and conveniently phosphorescent (invisible green #30 purchased from Shannon Industries, Santa Ana, Calif.) was screen-printed with a coverage of approximately 400 square feet per gallon using a 6XX silk screen. The resulting label material was cut into strips and employed for autoradiographic purposes as described above in Example 1.

Other embodiments are within the following claims.

I claim:

1. Marking tape adapted for use in autography, comprising:

a substrate having an upper surface, a phosphorescent coating applied to said upper surface, said coating including phosphor powder grains, said grains phosphorescing with light at a wavelength between 400 and 600 nm upon exposure to UV or visible light, said phosphorescing occurring for a period of at least 5 minutes after said exposure, the concentration of said grains being sufficient to emit sufficient photons and thereby cause X-ray film having a sensitivity of 2000 EI to darken to an optical density of between 0.2 and 3.0.

2. The marking tape of claim 1 wherein said coating includes phosphor powder grains smaller than 100 mesh size.

3. The marking tape of claim 1 wherein said coating is formed by screen printing.

4. The marking of claim 1 wherein said optical density is between 1.0 and 2.0.

5. The marking tape of claim 1 wherein said substrate has a lower surface comprising adhesive.

6. The marking tape of claim 5 wherein said adhesive is pressure-sensitive adhesive.

7. The marking tape of claim 6 wherein said lower surface is provided with a protective layer to prevent adhesion of said adhesive to an object prior to use of said marking tape.

8. The marking tape of claim 1 wherein said phosphorescent coating further comprises a marking layer which prevents said grains from phosphorescing in response to said UV or visible light or prevents said photons passing through said marking layer.

9. The marking tape of claim 8 wherein said marking layer comprises black ink.

10. The marking tape of claim 1 wherein the lower surface of said tape is applied to an object comprising radioactive or photon-emitting material.

11. The marking tape of claim 10 wherein said object is selected from the group consisting of electrophoretic slab gels, chromatograms, permeable membranes, animal tissue sections and plant tissue sections.

12. The marking tape of claim 10 wherein said object is placed adjacent an X-ray film.

13. A marking tape adapted for use in autography comprising:

a substrate having an upper surface;

a phosphorescent coating applied to said upper surface, said coating including phosphor powder grains, said grains phosphorescing with light at a wavelength between 400 and 600 nm upon exposure to UV or visible light, said phosphorescing occurring for a period of at least 5 minutes after said exposure, the concentration of said grains being sufficient to emit the same number of photons as are emitted from a coating having between 0.5 and 5.0 g per meter$^2$ of trace metal activated zinc sulfide crystals, comprising between 2 and 5 parts per million each of copper, lead, chromium, beryllium, arsenic, and mercury.

14. A method for marking an X-ray film during autography, comprising the steps of:

(a) providing a marking tape adapted for use in autography comprising a substrate having an upper surface, a phosphorescent coating applied to said upper surface, said coating including phosphor powder grains, said grains phosphorescing with light at a wavelength between 400 and 600 nm upon exposure to UV or visible light, said phosphorescing occurring for a period of at least 5 minutes after said exposure, the concentration of said grains being sufficient to emit sufficient photons and thereby cause X-ray film having a sensitivity of 2000 EI to darken to an optical density of between 0.2 and 3.0, (b) marking said upper surface of said phosphorescent coating with an ink which prevents said grains phosphorescing at points beneath said ink or prevents said photons emitted by said phosphor from contacting said X-ray film at points above said ink, (c) placing said marking tape on an object comprising a radioactive or photon-emitting material, (d) exposing said marking tape to ultraviolet or visible light to cause said grains to phosphoresce, (e) placing said object and said marking tape adjacent an X-ray film, and (f) allowing photons from said marking tape to contact said X-ray film.

* * * * *